US007293310B1

(12) United States Patent
Hansen

(10) Patent No.: US 7,293,310 B1
(45) Date of Patent: Nov. 13, 2007

(54) PILLOW FOR EXPECTED MOTHERS

(76) Inventor: Bonnie J. Hansen, 2144 Cameron Dr., Woodbury, MN (US) 55125

( * ) Notice: Subject to any disclaimer, the term of this patent is extended or adjusted under 35 U.S.C. 154(b) by 0 days.

(21) Appl. No.: 11/500,744

(22) Filed: Aug. 8, 2006

(51) Int. Cl.
*A47C 20/00* (2006.01)

(52) U.S. Cl. ..... 5/631; 5/632; 5/652; 5/655.9

(58) Field of Classification Search ..... 5/630–632, 5/652, 655.9, 648, 930
See application file for complete search history.

(56) References Cited

U.S. PATENT DOCUMENTS 4,173,048 A * 11/1979 Varaney ..... 5/632
4,288,879 A 9/1981 Pate
4,506,396 A 3/1985 Ritchie, Jr. et al.
4,624,021 A * 11/1986 Hofstetter ..... 5/632
4,901,384 A * 2/1990 Eary ..... 5/632
4,984,315 A 1/1991 Ortman et al.
5,097,551 A * 3/1992 Smith ..... 5/652
D333,938 S 3/1993 Watson et al.
5,664,271 A 9/1997 Bellavance
5,978,990 A * 11/1999 Akey ..... 5/632
6,349,437 B1 * 2/2002 Horning ..... 5/632
6,499,164 B1 * 12/2002 Leach ..... 5/632
6,886,201 B1 5/2005 Weiss-Lohrei
7,055,196 B2 * 6/2006 Littlehorn ..... 5/631
7,089,614 B1 * 8/2006 Clapp ..... 5/632
7,114,206 B2 * 10/2006 Leach ..... 5/632

* cited by examiner

*Primary Examiner*—Michael Trettel

(57) ABSTRACT

A bifurcated pillow for use by expectant mothers so they can comfortably lie on their sides. The pillow supports an expectant mother's abdomen and legs and has soft flaps that engage the rear of the woman's legs so the pillow will remain in position.

2 Claims, 1 Drawing Sheet

PILLOW FOR EXPECTED MOTHERS

TECHNICAL FIELD OF THE INVENTION

The present invention relates to the general art of pillows, and to the particular field of special purpose pillows.

BACKGROUND OF THE INVENTION

Women in advancing stages of pregnancy typically suffer from discomfort due to a number of sources often resulting in a reduced ability to sleep. Current medical advice is for pregnant women to sleep on their side after the 18th week of pregnancy, as opposed to sleeping on their back, particularly sleeping on the left side. More particularly, curling up or stretching out on your side, preferably with one leg crossed over the other with a pillow positioned between the legs, is recommended. Sleeping on your back can result in the increasingly growing uterus pressing on major arterial vessels possibly resulting in a decreased blood supply for both the mother and the baby. Furthermore, proper positioning and support for the abdomen enhances kidney function and a resultant improved elimination of waste and, therefore, less fluids and less swelling of the ankles, feet and hands.

It is often difficult for a pregnant woman to sleep and rest during the latter stages of pregnancy. While there are many reasons for this difficulty, one of the principal reasons given by pregnant women and their physicians is the inability of a pregnant woman to comfortably support her expanded abdomen while lying in bed during the latter stages of pregnancy. And, of course, as a pregnant woman approaches full term pregnancy, expansion of her abdomen occurs at a faster rate and it becomes increasingly more difficult for her to obtain the sleep and rest which she requires. Unfortunately, this occurs at a time when the pregnant woman's physician is prescribing increased sleep and rest for the benefit of both the pregnant woman and her unborn child.

In the past, a pregnant woman's only practical alternative was to sleep and rest lying flat on her back during the latter stages of pregnancy. But, it is well known that many people are in the habit of sleeping and resting on either their right side or their left side. It is also well known that one's sleeping and resting habits are usually formed during early childhood. Often a pregnant woman who has been accustomed to sleeping and resting on her side since early childhood cannot comfortably sleep and rest on her back during the latter stages of pregnancy.

Therefore, there is a need for a means for supporting a woman's stomach and legs so she can sleep on her side during pregnancy. However, any such support should be stable so that once positioned, it will remain in position so any support will be more than transitory.

SUMMARY OF THE INVENTION

The above-discussed disadvantages of the prior art are overcome by a bifurcated pillow for use by expectant mothers so they can comfortably lie on their sides. The pillow supports an expectant mother's abdomen and legs and has soft flaps that engage the rear of the woman's legs so the pillow will remain in position.

Using the pillow embodying the present invention will permit an expectant mother to support her legs and stomach while she lies on her side. The pillow will remain in place during sleep so the pillow will remain in position during sleep.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 2:
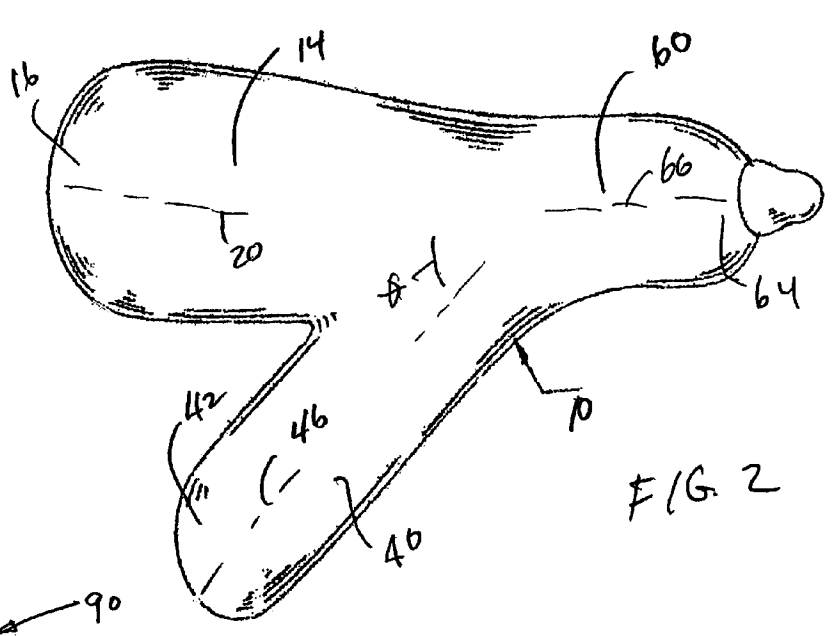
FIG. 2 is a top view of the pillow.
Figure 3:
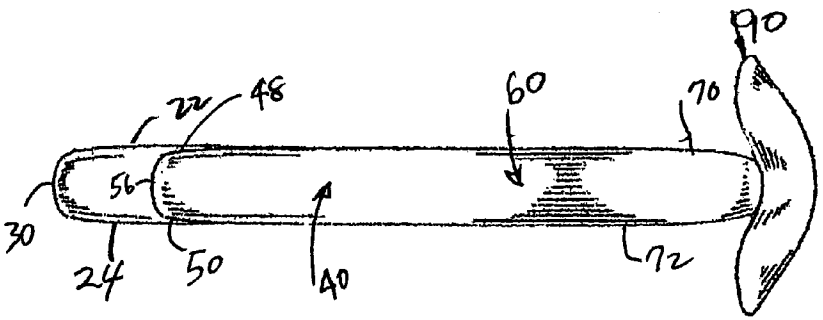
FIG. 3 is a side view of the pillow.

Referring to the figures, it can be understood that the present invention is embodied in a pillow 10 for supporting a woman's stomach while she lies on her side. Pillow 10 comprises a Y-shaped body 12 which includes a first leg 14 formed of medium soft foam. First leg 14 has a distal end 16, a proximal end 18 and a length dimension 20 which is measured between distal end 16 and proximal end 18. Leg 14 further includes a first surface 22, a second surface 24, a first edge 26, a second edge 28 and a third edge 30 which is located adjacent to distal end 16 and which connects the first and second edges together. First leg 14 is located between the user's legs when the pillow is in use with the first and second surface being oriented in a horizontal direction.

Pillow 10 further comprises a second leg 40 formed of foam that is softer than the foam in the first leg. Second leg 40 has a distal end 42, a proximal end 44 and a length dimension 46 which is measured between distal end 42 and proximal end 44 of the second leg. Length dimension 46 of the second leg is less than length dimension 20 of the first leg. Second leg 40 further includes a first surface 48 which is co-planar with first surface 22 of the first leg and a second surface 50 which is co-planar with second surface 24 of the first leg. Second leg 40 further includes a first edge 52, a second edge 54 which is connected to second edge 28 of the first leg at the proximal ends of the first and second legs. A third edge 56 of the second leg is located on distal end 42 of the second leg and connects the first and second edges of the second leg together.

Pillow 10 further includes a third leg 60 which has a proximal end 62 which is connected to the proximal ends of the first and second legs, a distal end 64 and a length dimension 66 which is measured between proximal end 62 of the third leg and distal end 64 of the third leg. Third leg 60 further includes a first surface 70 which is co-planar with the first surfaces of the first and second legs and a second surface 72 which is co-planar with the second surfaces of the first and second legs. Length dimension 66 of the third leg is co-linear with length dimension 20 of the first leg. Third leg 70 further has a first edge 74 which is connected to first edge 26 of first leg 14 at proximal end 18 of the first leg and at proximal end 62 of third leg 60. A second edge 76 of the third leg which is connected to first edge 52 of second leg 40 at the proximal ends of the second and third legs. The first edge of the second leg and the second edge of the third leg forming a smooth concave shape 80 which will be located adjacent to the user's stomach when the pillow is in use.

Figure 1:
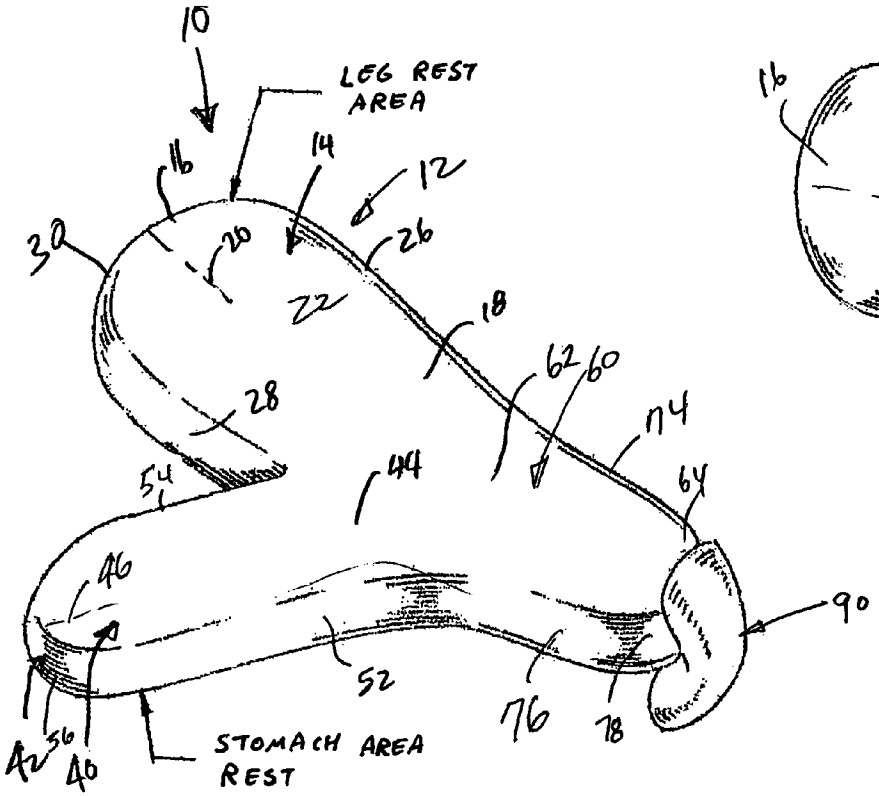
FIG. 1 is a perspective view of a pillow embodying the present invention.

Second leg 40 extends at an oblique angle θ with respect to the first leg so pillow 10 has a skewed Y shape as can be seen in FIGS. 1 and 2. A flap 90 is mounted on third edge 78 of the distal end of the third leg and extends perpendicular to and beyond the plane containing the surfaces of the first, second and third legs. Flap 90 is formed of foam which is similar in softness to the foam in the second leg.

A user lies on her side, places legs 14 and 60 between her legs, and places her stomach on the pillow adjacent to edges 52 and 76, with flap 90 abutting her legs. The flap will hold the pillow in place so it will not fall out when the user shift's her position. The pillow supports the user's stomach and provides a comfortable and stable support for her.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A pillow comprising:

A) a Y-shaped body including (1) a first leg formed of medium soft foam, the first leg having a distal end, a proximal end, a length dimension measured between the distal end and the proximal end, a first surface, a second surface, a first edge, a second edge and a third edge adjacent to the distal end and connecting the first and second edges, (2) a second leg formed of foam that is softer than the foam in the first leg, the second leg having a distal end, a proximal end, a length dimension measured between the distal end of the second leg and the proximal end of the second leg, the length dimension of the second leg being less than the length dimension of the first leg, a first surface which is co-planar with the first surface of the first leg, a second surface which is co-planar with the second surface of the first leg, a first edge, a second edge which is connected to the second edge of the first leg at the proximal ends of the first and second legs, and a third edge located on the distal end of the second leg and connecting the first and second edges of the second leg, (3) a third leg having a proximal end which is connected to the proximal ends of the first and second legs, a distal end, a length dimension measured between the proximal end of the third leg and the distal end of the third leg, a first surface which is co-planar with the first surfaces of the first and second legs, a second surface which is co-planar with the second surfaces of the first and second legs, the length dimension of the third leg being co-linear with the length dimension of the first leg, a first edge which is connected to the first edge of the first leg at the proximal end of the first leg and at the proximal end of the third leg, a second edge which is connected to the first edge of the second leg at the proximal ends of the second and third legs, the first edge of the second leg and the second edge of the third leg forming a smooth concave shape, and (4) the second leg extending at an oblique angle with respect to the first leg; and B) a flap mounted on the third edge of the distal end of the third leg and extending perpendicular to and beyond the plane containing the surfaces of the first, second and third legs, the flap being formed of foam which is similar in softness to the foam in the second leg.

2. A pillow comprising:

A) a Y-shaped body including (1) a first leg formed of medium soft foam, the first leg having a length dimension, a first surface, a second surface, a first edge, and a second edge, (2) a second leg formed of foam that is softer than the foam in the first leg, the second leg having a length dimension which is less than the length dimension of the first leg, a first surface, a first edge, a second edge which is connected to the second edge of the first leg, (3) a third leg connected to the first and second legs and having a length dimension, a first surface which is co-planar with the first surfaces of the first and second legs, a second surface which is co-planar with the second surfaces of the first and second legs, the length dimension of the third leg being co-linear with the length dimension of the first leg, a first edge which is connected to the first edge of the first leg, a second edge which is connected to the first edge of the second leg, the first edge of the second leg and the second edge of the third leg forming a smooth concave shape, and (4) the second leg extending at an oblique angle with respect to the first leg; and B) a flap mounted on the third leg and extending upright with respect to and beyond the plane containing the surfaces of the first, second and third legs, the flap being formed of foam which is similar in softness to the foam in the second leg.

* * * * *